US007281528B2

(12) United States Patent
Jones et al.

(10) Patent No.: US 7,281,528 B2
(45) Date of Patent: Oct. 16, 2007

(54) METHOD AND APPARATUS FOR A MECHANICALLY DRIVEN SUPERCHARGER

(75) Inventors: Daniel W. Jones, Lenexa, KS (US); Michael A. Carlson, Lenexa, KS (US)

(73) Assignee: Accessible Technologies, Inc., Lenexa, KS (US)

( * ) Notice: Subject to any disclaimer, the term of this patent is extended or adjusted under 35 U.S.C. 154(b) by 0 days.

(21) Appl. No.: 11/589,066

(22) Filed: Oct. 30, 2006

(65) Prior Publication Data

US 2007/0095333 A1 May 3, 2007

Related U.S. Application Data

(60) Provisional application No. 60/732,400, filed on Nov. 1, 2005.

(51) Int. Cl.
*F02B 33/00* (2006.01)

(52) U.S. Cl. ..... 123/559.1; 60/605.1

(58) Field of Classification Search ..... 123/559.1, 123/559.2, 566; 60/605.1, 605.2
See application file for complete search history.

(56) References Cited

U.S. PATENT DOCUMENTS 4,457,061 A * 7/1984 Eason ..... 29/264
4,825,970 A * 5/1989 McVicar et al. ..... 180/53.7
4,922,749 A * 5/1990 Steffes et al. ..... 73/116
5,607,247 A * 3/1997 Lauritano ..... 403/16
6,439,208 B1 8/2002 Jones
6,474,318 B1 11/2002 Jones et al.
6,478,016 B1 11/2002 Roderique
6,478,469 B1 11/2002 Jones
6,516,789 B1 2/2003 Jones
6,571,780 B1 6/2003 Jones et al.
6,612,747 B1 9/2003 Jones
6,651,633 B1 11/2003 Jones
6,691,685 B2 2/2004 Jones et al.
6,786,044 B2 9/2004 Jones et al.
7,051,824 B1 5/2006 Jones et al.
2003/0150433 A1 8/2003 Jones et al.
2004/0123848 A1 7/2004 Jones et al.

* cited by examiner

*Primary Examiner*—Hoang Nguyen
(74) *Attorney, Agent, or Firm*—Intellectual Property Center, LLC; Arthur K. Shaffer

(57) ABSTRACT

The present invention provides a method for mechanically driving a supercharger and a combination harmonic pulley system and supercharger mounted on a powered vehicle including a crankshaft, the supercharger having a supercharger driveshaft and adapted to provide boost air to the intake of the internal combustion engine, driving the crankshaft which rotates the harmonic pulley system. In general the harmonic pulley system includes a harmonic balancer, a drive shaft pulley, a crankshaft bolt, an alignment structure and a drive belt. The harmonic balancer having a first and second ledge, an annular ring and a central aperture, the driveshaft pulley having an inner and outer region, the inner region includes a first shoulder and presenting a pulley aperture aligned with the central aperture, the outer region including a second shoulder and providing an engaging surface. The crankshaft bolt is received by the engine crankshaft through the pulley aperture and the central aperture wherein said driveshaft pulley is compressed towards the harmonic balancer, the first ledge receiving the first shoulder and the second ledge receiving the second shoulder, said annular ring positioned therebetween. The alignment structure aligns the driveshaft pulley with said harmonic balancer and the drive belt encircles the engaging surface and the supercharger driveshaft whereby the supercharger is mechanically driven by said harmonic pulley system.

6 Claims, 4 Drawing Sheets

METHOD AND APPARATUS FOR A MECHANICALLY DRIVEN SUPERCHARGER

CROSS-REFERENCE TO RELATED APPLICATION

This application claims the benefit of the prior filed U.S. provisional application No. 60/732,400 filed Nov. 1, 2005 which is incorporated herein by reference.

FIELD OF THE INVENTION

This invention relates to an internal combustion engine having a supercharger and a crankshaft associated with a harmonic balancer. More specifically, the invention provides an apparatus for mounting a harmonic pulley system to the crankshaft with a single bolt and a process for driving a supercharger with the harmonic pulley system having a central point of attachment therebetween.

BACKGROUND OF THE INVENTION

An internal combustion engine utilizes fuel and air under pressure to create an explosion, or controlled burn, in a combustion chamber to convert translational energy into rotational energy. This rotational energy may be applied to the drive wheels of a vehicle, the propeller of a boat, airplane or any rotary device.

In a carbureted system, the operator may adjust the size of the orfice or jets which are used to transfer the fuel from the fuel holding area of the carburetor to the air column to adjust for possible changes in atmospheric conditions. This may present a disadvantage for some carbureted engines in that the jets must be changed manually and are therefore not typically electronically controlled.

In addition, the intake manifold of an engine is designed to deliver equal quantities of the air-fuel charge to each cylinder, such as but not limited to passenger vehicles which typically have 4 to 12 cylinders, while preventing the charge from one cylinder to interfere with the flow of the charge to another.

Many factors may influence the flow of charge to the individual cylinders including the number of cylinders, their geometric orientation which may be a "V" style or aligned linearly with the cylinders in a row. Other factors may include the depth and diameter of the cylinders, the throttle position—whether it is wide-open or closed as in the idle position, the cross-sectional area of each runner which directs the charge to an individual cylinder and numerous other factors not specifically listed here. Some rise tracts leading to each cylinder are designed to produce a minimum idling air velocity which can support the heavier fuel particles in the air stream while remaining large enough to support combustion at wide open throttle. In some cases, the optimum manifold design for a low engine speeds may not be optimum for a high speed engine due the pressure-waves created in the manifold tracks and the opening and closing of the intake valve. As the intake valve opens, the pressure in the cylinder may be reduced thereby creating a negative pressure-wave, which travels through the air column to the atmosphere, influencing the delivery of the charge to the remaining cylinders. Similarly, as the engine speed increases, the duration of time the intake valve is open decreases, thereby decreasing the volumetric efficiency of the engine. It would therefore be beneficial to design a manifold which provides for a large amount of volumetric efficiency based on the particular engine configuration over the range of operating conditions from closed to wide open throttle.

Centrifugal superchargers may increase the pressure of the intake air by utilizing a compressor powered by the engine. It would therefore be beneficial to provide a positive displacement pump such as but not limited to the vane, rotor style superchargers which may provide a charge output which is directly proportional to the speed at which the rotor blade is rotating.

In addition, some root, screw or vane style superchargers require a larger foot print within the engine compartment and may cause an increase in weight to a particular vehicle. Some vane, root and screw-style superchargers are positioned above the intake manifold to force the compressed charge into the cylinders. However, these root, screw or vane style superchargers may have limited use because they are designed to be placed at a particular location within a particular model of a vehicle. It would therefore be beneficial to provide a rotary style centrifugal supercharger having a compact design which can be utilized in a supercharger application, in addition, it would be beneficial to allow for the positioning of the supercharger at a number of different locations within the engine compartment, or within a number of different models of vehicles.

While a supercharger, may be driven with a crankshaft connected to a belt which is associated with the supercharger, a balancer may be mounted on the crankshaft, obstructing the crankshaft of the engine. In some instances, the clearance of the balancer mounted on the crankshaft in combination with surrounding components may limit the ability to connect the supercharger to the crankshaft. In addition, attaching and driving the supercharger belt may require utilizing an aftermarket harmonic balancer having tapered and threaded holes for mating to the drive pulley. However, it is often difficult to replace the balancer with an aftermarket balancer due to the limited space in the engine compartment. In some cases, components may need to be removed or worse, the engine may need to be raised or removed to gain access to the crankshaft. In addition, in some cases replacing the original equipment manufacturer (OEM) with an aftermarket harmonic balancer increases the over cost of installing a supercharger system. It would therefore be beneficial to provide a harmonic balancer which does not require the removal or raising of the engine, does not cause an increased expense to the installation of a supercharger system and does not require the purchase of an aftermarket balancer pulley.

Another concern in supercharger installation applications is the alignment of the supercharger belt. Improper belt alignment may cause the supercharger to fail or may cause excessive wear to the supercharger belt which may lead to failure of the supercharger system. In addition, alignment of the supercharger belt may be difficult in a compact engine compartment. Thus, when it is impractical to replace the balancer with an aftermarket harmonic balancer or if belt alignment is a concern, an installer may elect to drive the supercharger belt at another location such as the alternator, water pump or power-steering pulley. This may result in a loss of engine horsepower. Furthermore, there are safety issues with using accessory drive pulleys such as power-steering pump or alternator pulleys. If the belt or supercharger fails, the operator will loose the use of accessory drive pulleys. Therefore, it would be beneficial to provide a method and apparatus for mechanically driving an engine with a drive pulley associated with the harmonic balancer which can be mounted in compact engine compartments, minimizes the loss of horsepower and does not cause safety concerns associated with mounting the belt on an accessory drive pulley.

Additionally, engaging the drive pulley at an alternative location may limit the width of the pulley belt which can be used. A wider drive belt may allow for increased horsepower applied to the pulley and supercharger. However, attaching the supercharger at an alternative drive pulley location may limit the belt to a six ribbed belt, potentially limiting the amount of horsepower. It would therefore be beneficial to provide for the use of a wider ribbed belt for driving the pulley by the engine crankshaft via the harmonic balancer. It is therefore, advantageous to develop a belt drive pulley that can be driven by the crankshaft at the harmonic balancer, reducing the cost of a supercharger system and that can be installed without pulling the motor out of the engine compartment.

SUMMARY OF THE INVENTION

The present invention provides a combination harmonic pulley system and supercharger mounted on a powered vehicle including a crankshaft, where the supercharger includes a supercharger driveshaft powered by the harmonic pulley system, the supercharger being adapted to provide boost air to an internal combustion engine for driving the crankshaft which rotates the harmonic pulley system. In general the harmonic pulley system includes a harmonic balancer, a drive shaft pulley, a crankshaft bolt, an alignment structure and a drive belt. The harmonic balancer has a first and second ledge, an annular ring and a central aperture. The driveshaft pulley has an inner and outer region, the inner region includes a first shoulder and presents a pulley aperture aligned with the central aperture the outer region including a second shoulder and providing an engaging surface. The crankshaft bolt is received by the engine crankshaft through the pulley aperture and the central aperture wherein said driveshaft pulley is compressed towards the harmonic balancer, the first ledge receiving the first shoulder and the second ledge receiving the second shoulder, said annular ring positioned therebetween. The alignment structure aligns the driveshaft pulley with said harmonic balancer and the drive belt encircles the engaging surface and the supercharger driveshaft whereby the supercharger is mechanically driven by said harmonic pulley system. In accordance with another aspect of the present invention a harmonic pulley system may include a harmonic balancer, a driveshaft pulley a crankshaft bolt and a plurality of alignment pins extending from said driveshaft pulley through said harmonic balancer at plural pin receivers in said harmonic balancer. A method of driving a harmonic balancer is also provided by the present invention, the method including the steps of attaching a drive pulley to the harmonic balancer at a single attachment point, plastically deforming the harmonic balancer drive pulley, maintaining contact along an annular ring of the harmonic balancer and the drive pulley and rotating the drive pulley by the rotation of the harmonic balancer by the rotation of the crankshaft of the internal combustion engine. Another aspect of the present invention includes an apparatus for driving a belt using an original equipment manufacturer harmonic balancer of an internal combustion engine of a powered vehicle, the apparatus including an original equipment manufacturer harmonic balancer having a center axially located hole, a crankshaft with a single attachment point a drive pulley having a hole, and a fastener threaded sequentially through said pulley, said harmonic balancer, into said crankshaft.

DETAILED DESCRIPTION OF THE INVENTION

I. Introduction

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

II. A Combination Harmonic Pulley System and Supercharger

Figure 1:
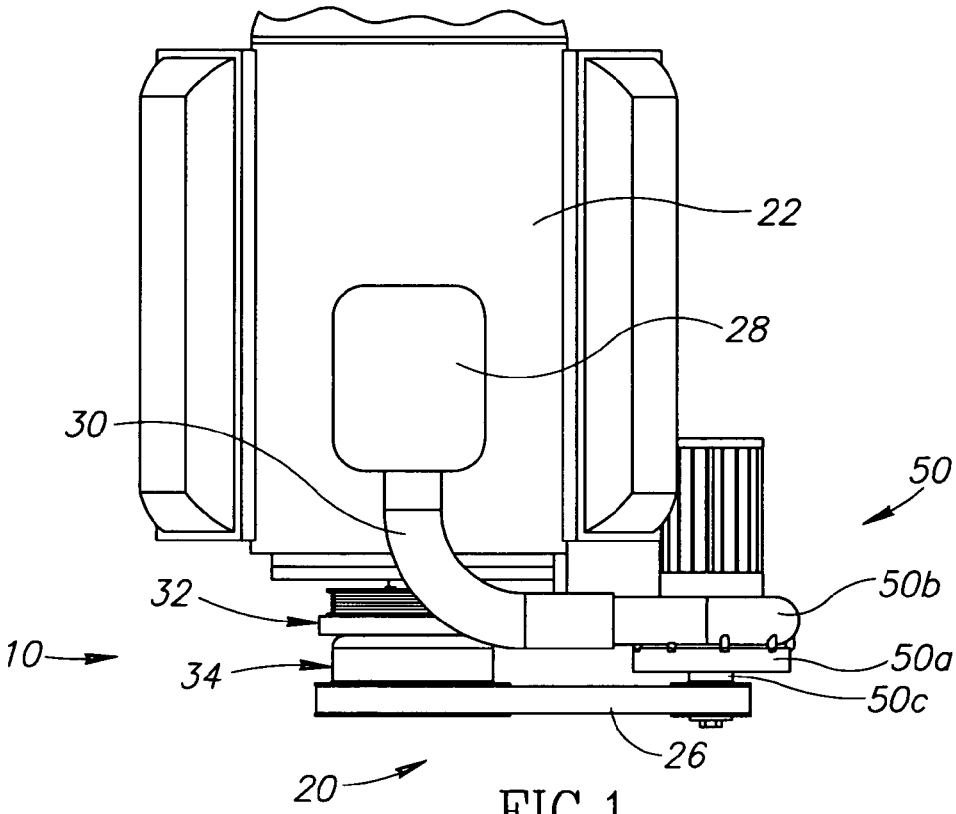
FIG. 1 is a top plan view of the combination harmonic pulley system and supercharger.

Referring to FIG. 1, an embodiment of the present invention a harmonic pulley system in combination with a supercharger is generally indicated by reference numeral 20, shown in use with an internal combustion engine 22 of a powered vehicle such as but not limited to a boat or automobile. In addition, other power adders such as centrifugal compressors such as turbine engines or centrifugal pumps operating on compressible fluids may also benefit from the disclosed invention. Although the illustrated engine 22 is a v-engine, the present invention may also be applied to various other types of engines, including a straight, flat or w-engine.

In general, however, the combination harmonic pulley system and supercharger 20 illustrated in FIG. 1 is driven by a crankshaft 24 associated with the engine 22. The combination 20 is illustrated with a harmonic pulley system 10 including a harmonic balancer or dampner 32 secured to a driveshaft pulley 34 with a fastening structure and a belt 26 being operably connected between the harmonic pulley system 10 and the supercharger 50. A crankshaft 24 generally extends along the lower interior of the engine 22 terminating at the harmonic balancer 32. In general, the combination 20 is mounted to an internal combustion engine, the supercharger 50 operably connected to the harmonic pulley system 20 and adapted to provide boost air to the intake of the internal combustion engine 22 for combustion within said engine 22 to drive the crankshaft 24 which rotates the harmonic pulley system 20 which mechanically drives the supercharger 50.

Figure 2:
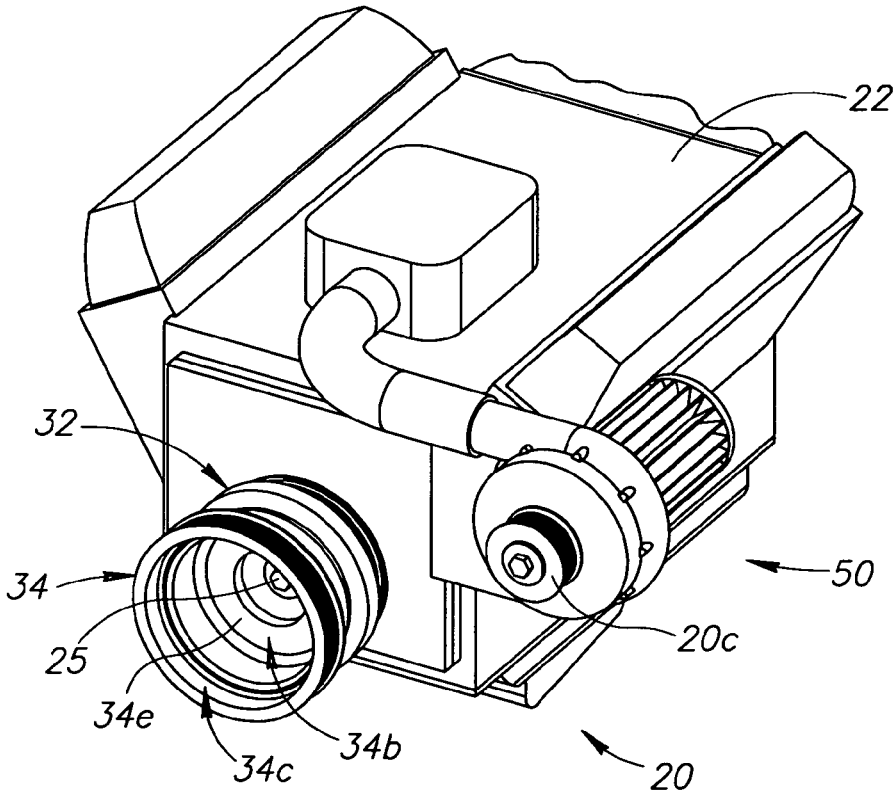
FIG. 2 is a perspective view of the combination illustrated in FIG. 1.
Figure 3:
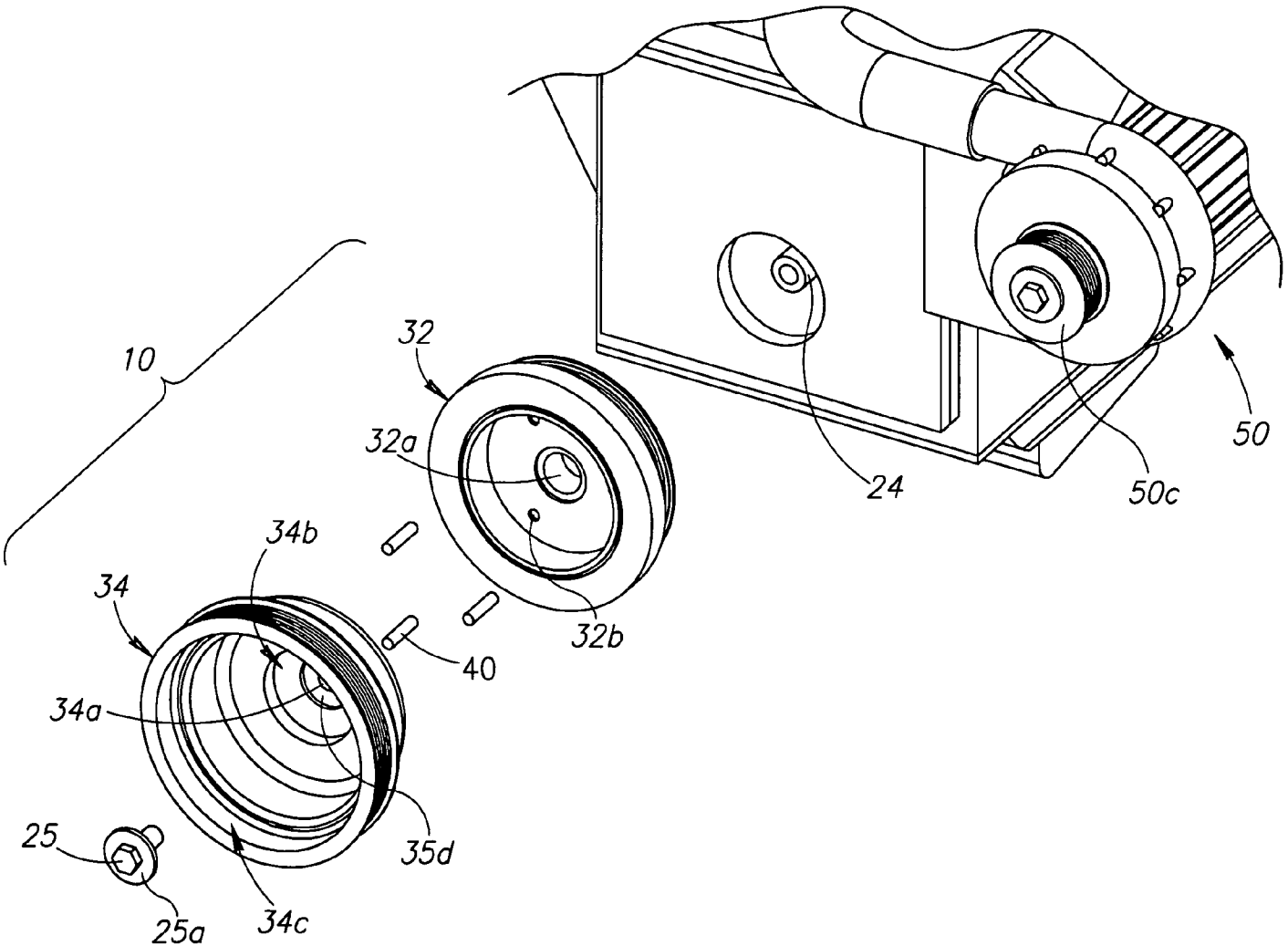
FIG. 3 is a partial cut-away, exploded perspective view of the combination illustrated in FIG. 1

The fastening structure may include a number of different configurations, however, in FIG. 1; the drive pulley 34 is secured to the harmonic balancer 32 and to the crankshaft 24. FIG. 2 generally illustrates a crankshaft bolt 25 being threaded through both the drive pulley 34 and the harmonic balancer 32 and into the crankshaft 24. FIG. 3 illustrates the crankshaft bolt 25 with an optional washer 25*a* being received by both a pulley aperture 34*a* and a central aperture 32*a* centrally located through the pulley 34 and balancer 32 respectively. As illustrated, the pulley aperture 34*a* and central aperture 32*a* may be generally aligned with one another and with the crankshaft 24. Optionally, an extended bolt (not shown) may be utilized for securing the harmonic pulley system 10 to the crankshaft 24.

As illustrated in FIG. 2, the drive pulley 34, generally includes an inner and outer region 34*b*, 34*c*, the inner region 34*b* including a first shoulder 34*d* and presenting the pulley aperture 34*a* configured to receive the crankshaft bolt 25. When the pulley aperture 34*a* is in receipt of the crankshaft bolt 25, the pulley 34 is generally fixed adjacent to the harmonic balancer 32 and to the crankshaft 24 with the crankshaft bolt 25 being received by the crankshaft 24. The outer region 34*c* includes a second shoulder 34*e* and provides an engaging surface 34*f* for engaging the belt 26 for operating a power adder such as the supercharger 50 or another vehicle drive accessory. Typical superchargers may include a supercharger driveshaft (not shown) extending towards the supercharger transmission 50*a* which drives the rotary impeller (not shown) of a supercharger compressor 50*b*. As the crankshaft 24 of the engine 22 rotates, the drive pulley 34 operably rotates the belt 26 around the supercharger driveshaft 20*c*.

The supercharger 50 is connected to an engine intake 28 (e.g., an intake plenum box, intake manifold, etc.) by a conduit 30, such that pressurized air, generated by the rotation of the impeller (not shown) of the compressor 50*b* associated with the supercharger 50, is directed towards the engine intake 28.

As illustrated in FIG. 2, the harmonic balancer 32 is also shown in receipt of drive pulley 34 with the crankshaft bolt 25 threaded therethrough and into the crankshaft 24 of the engine 22, the drive belt 26 (removed for visual clarity) encircling the drive pulley 34 and the supercharger driveshaft 50*c*. Optionally, a second pulley (not shown) may be used for driving the supercharger 50, the second pulley being associated with another drive accessory such as but not limited to a water pump, power steering pump or alternator (not shown).

In addition to facilitating the addition of the driveshaft pulley 34 to a stock engine 22, the use of the present invention 20 also provides for an expedited removal process without the need to raise or remove the engine 22, allowing the vehicle to be quickly returned a prior unmodified condition.

FIG. 3 illustrates the harmonic pulley system 10 with the crankshaft bolt 25 is received by the crankshaft 24 through the pulley aperture 34*a* and the central aperture 32*a*. In addition, a plurality of pins 40 extend from the driveshaft pulley 34 towards the harmonic balancer 32 which includes a plurality of pin receivers 32*b* adapted for receiving the pins 40. As illustrated, the harmonic balancer 32 is substantially planar, however, the balancer 32 may include sections which have been removed to save on weight or to provide other advantages in which the harmonic balancer 32 resembles a spoke configuration or another irregular shape. The crankshaft bolt 25 may also include a washer 25*a*. The crankshaft bolt 25 may be mechanically fastened to the crank 24 for example but not as a limitation, using mechanical screw threads. As the crankshaft bolt 25 is extended further towards the crankshaft 24, the driveshaft pulley 34 is compressed towards said balancer as further illustrated in FIG. 4.

Figure 4:
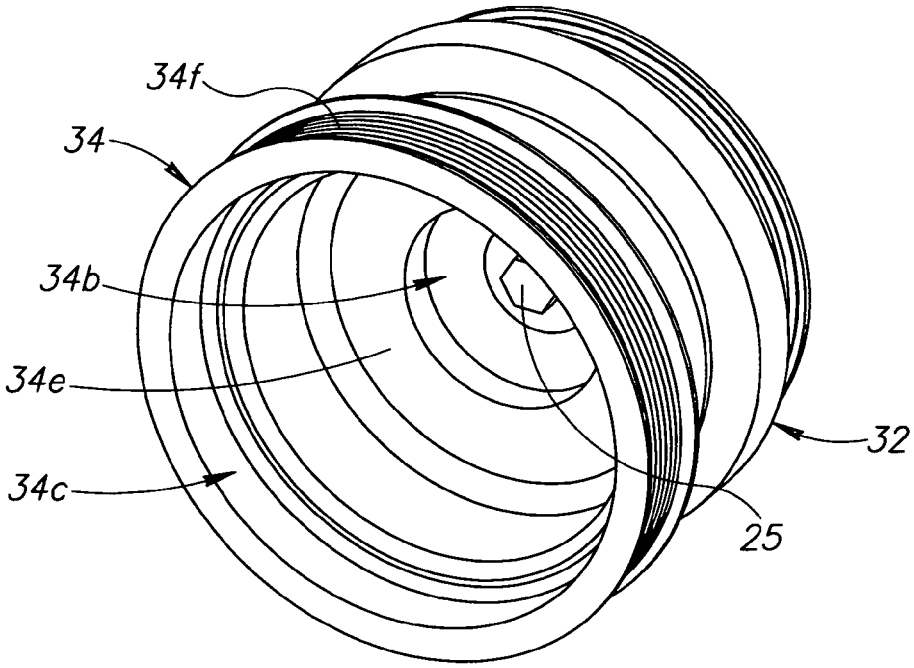
FIG. 4 is a perspective view of an assembled harmonic pulley system illustrated in FIG. 3.

As illustrated in FIG. 4, the harmonic pulley system 10 may include the pulley 34 being generally complementary configured for receipt by the harmonic balancer 32 with the drive pulley 34 outer dimensions being generally matched to the harmonic balancer inner dimensions. The driveshaft pulley of FIG. 4 includes a first shoulder 34*d* generally associated with the inner region 34*b* and a second shoulder 34*e* generally associated with the outer region 34*c*. However, in generally the driveshaft pulley is complementary configured to match the inner diameter of the harmonic balancer 32 and the crankshaft of the particular engine 22. In addition, both the harmonic balancer 32 and the driveshaft pulley 34 may be optionally configured to receiving separate drive belts.

Figure 5:
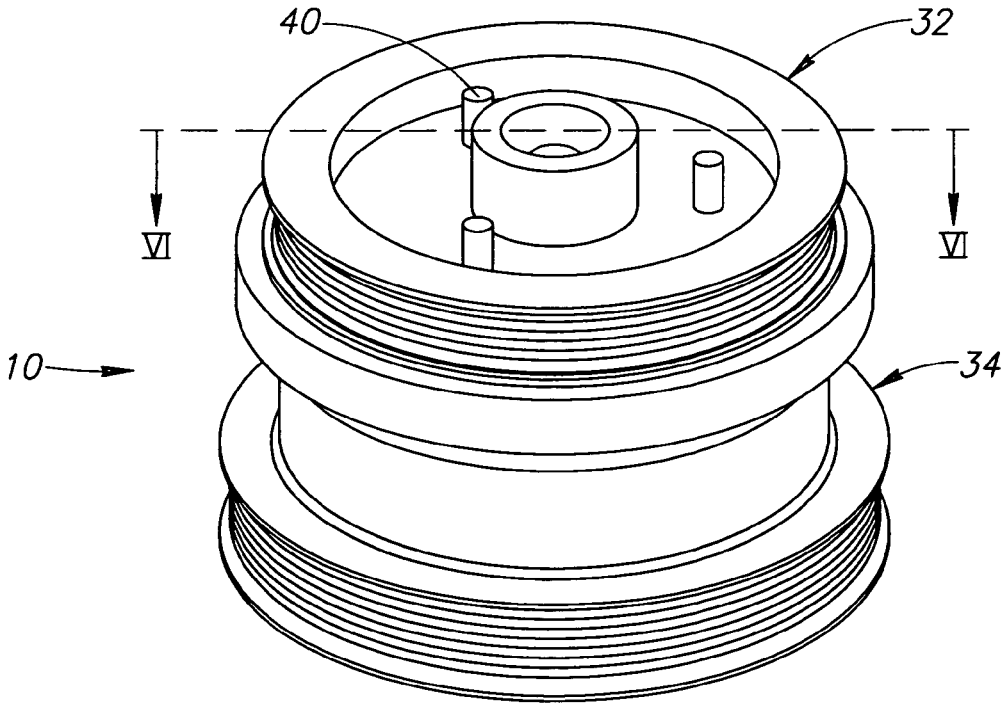
FIG. 5 is an assembled perspective view of the harmonic pulley system illustrated in FIG. 4.

Turning to FIG. 5, the harmonic pulley system 10 is illustrated with the drive pulley 34 including pins 40 extending therefrom and through the pin receivers 32*b* of the harmonic balancer 34. During operation, the pins 40 may help align the radial position of drive pulley 34 with the harmonic balancer 32 and during rotational movement they may limit the amount of misalignment between the pulley 34 and the harmonic balancer 32. Optionally, the harmonic balancer may include a magnetic pick-up for indicating the correct positioning for timing the vehicle engine. Use of the pins 40 may, therefore, also facilitate the positioning or adjusting of the harmonic balancer 32 to correct or adjust any timing concerns.

Figure 6:
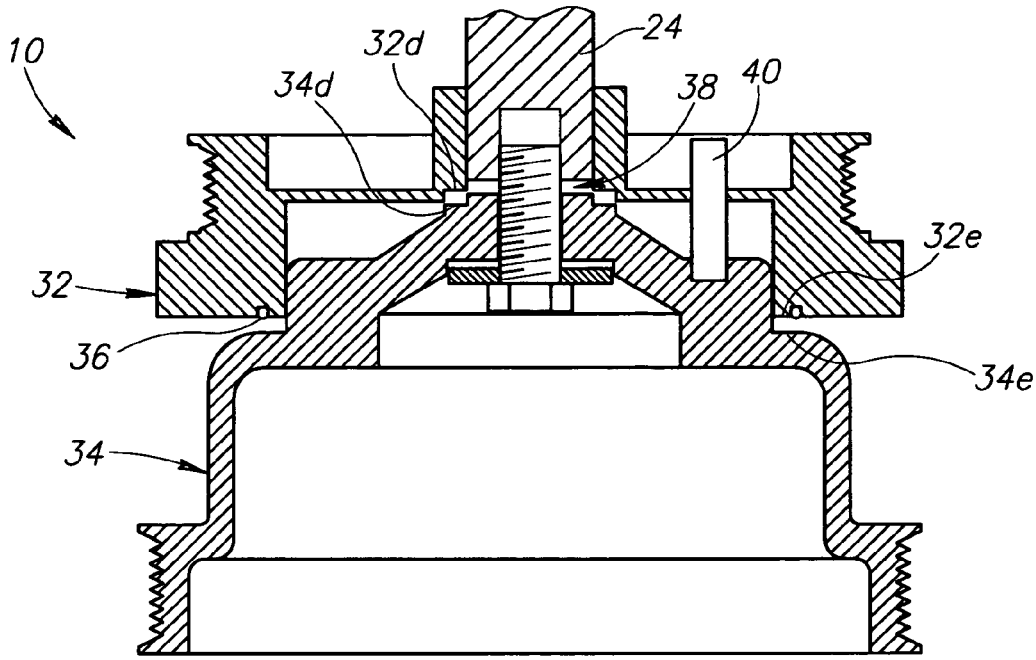
FIG. 6 is a cross-sectional view of the harmonic pulley system taken along line VI in FIG. 5.
Figure 7:
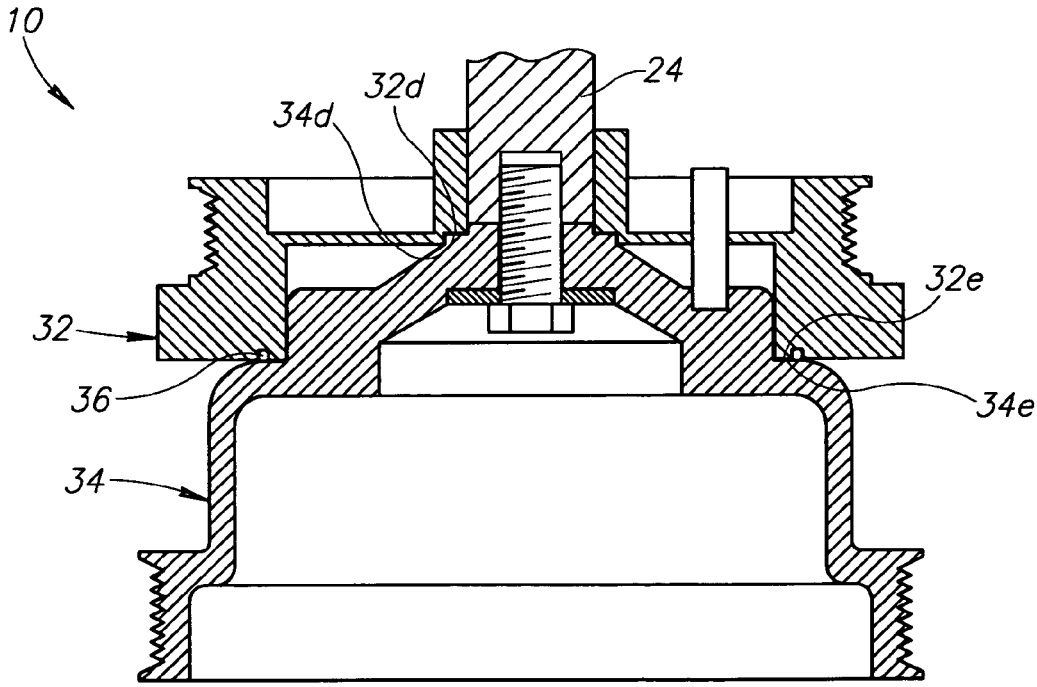
FIG. 7 is a cross-sectional view of the harmonic pulley system taken along line VI in FIG. 5.

A sectional view of harmonic pulley system 10 taken along line VI in FIG. 5 can be seen in FIG. 6 with the drive pulley 34 generally associated with the harmonic balancer 32, the crankshaft bolt 25 slightly separated from the crankshaft 25. In FIG. 7 the crankshaft bolt 25 is threaded through the pulley aperture 34*a* and the central aperture 32*a* and into the crankshaft 25. A first and second ledge 32*d*, 32*e* of the harmonic balancer 32 can be seen with an optional annular ring 36 positioned near the second ledge 32*d* to assist in maintaining contact between the balancer 32 and pulley 34.

A sectional view of the harmonic pulley system 10 taken along line VI in FIG. 5 can be seen in FIG. 6 with the drive pulley 34 received by the harmonic balancer 32, the crankshaft bolt 25 threaded through the pulley aperture 34*a* and the central aperture 32*a* respectively. A first and second ledge 32*d*, 32*e* of the harmonic balancer 32 can be seen with an optional annular ring 36 positioned near the second ledge 32*d* to assist in maintaining contact between the balancer 32 and pulley 34.

As seen in FIG. 6, the outer dimensions of the driveshaft pulley 34 are generally complementary configured for receipt by the interior of the harmonic balancer 32. As the crankshaft bolt 25 is fastened to the crankshaft 24, the driveshaft pulley 34 is compressed towards the balancer 32 with the first ledge 32*d* receiving the first shoulder 34*d* and the second ledge 32*e* receiving the second shoulder 34*e*. As the crankshaft bolt 25 is threaded onto the crankshaft 24, the driveshaft pulley 34 is compressed towards harmonic balancer 32, the first and second shoulders 34*d*, 34*e* may come into contact with the first and second ledges 32*d*, 32*e* and in some cases the pulley 34 may actually plastically deform.

Optionally, the pulley 34 may be configured with a reduced axial distance along the axial dimension of the first shoulder 34*d* which may be generally in the range of 0.010 inch. In this manner, as the pulley 34 is secured with the crankshaft bolt 25, an interference fit may result between the pulley 34 and the harmonic balancer 34 near the first shoulder—ledge 32*d*, 34*d* contact point. Thus, as crankshaft bolt 25 is tightened, the first shoulder 34*d* of the drive pulley 34 may be pulled along a center axis of the engine 22 resulting in the plastic deformation or an interference fit, maintaining contact between the harmonic balancer 32 and the driveshaft pulley 34. Likewise, the second shoulder 34*e* may also plastically deform axially towards the engine to maintain contact between the harmonic balancer 32 and the pulley 34. Additionally, as illustrated in FIG. 6 near the second shoulder 34*e* a radial opening 38 may be provided for allowing the pulley 34 to plastically deform radially outwards, towards the harmonic balancer 32 as the crankshaft bolt 25 is tightened onto the crankshaft 24.

To facilitate the plastic deformation, the pulley 34 may be undersized along the first and/or second shoulder 34*d*, 34*e* allowing for axial or radial expansion of the pulley 34. In addition, the drive pulley 34 may be fabricated from aluminum or another softer material which generally has a hardness rating softer than steel. As the pulley 34 is secured towards the crankshaft 24 between the crankshaft bolt 25 and the balancer 32, the pulley 34 plastically deforms into a complementary configuration in relation to the balancer 32.

In an alternative embodiment (not shown), the harmonic pulley system 10 may be used without the supercharger 50 in which case the crankshaft bolt 25 is secured to the crankshaft 24 through the driveshaft pulley 34 and the harmonic balancer 32. The driveshaft pulley 34 may then be used to engage another vehicle drive accessory.

Again, the principles of the present invention are not limited to the illustrated applications, but rather the drive pulley 34 may be associated with any system in which a drive pulley may be desired and where the drive pulley may be installed using an original equipment manufacturer harmonic balancer is desired. For example, it is entirely within the ambit of the present invention to utilize drive pulley 34 with various other types of internal combustion engines.

While the invention has been described with respect to specific examples including presently preferred modes of carrying out the invention, those skilled in the art will appreciate that there are numerous variations and permutations of the above described system and techniques that fall within the spirit and scope of the invention as set forth in the appended claims.

Having thus described the invention, what is claimed as new and desired to be secured by Letters Patent is:

1. A harmonic pulley system in combination with a supercharger mounted on an internal combustion engine including a crankshaft, the supercharger having a supercharger driveshaft powered by said harmonic pulley system to provide boost air to the internal combustion engine to drive the crankshaft, rotating the harmonic pulley system, said harmonic pulley system comprising:

a harmonic balancer having a first ledge, a second ledge, an annular ring and a central aperture, a driveshaft pulley having an inner and outer region, said inner region including a first shoulder and presenting a pulley aperture aligned with said central aperture, said outer region including a second shoulder and providing an engaging surface, a crankshaft bolt received by the crankshaft through said pulley aperture and said central aperture wherein said driveshaft pulley is compressed towards said balancer, said first ledge receiving said first shoulder, said second ledge receiving said second shoulder, said annular ring positioned therebetween, alignment structure for aligning said driveshaft pulley with said harmonic balancer, and a drive belt encircling said engaging surface and said supercharger driveshaft whereby said supercharger is mechanically driven by said harmonic pulley system.

2. The combination apparatus of claim 1 wherein said alignment structure further comprises:

a plurality of pin receivers located in said harmonic balancer, and a plurality of pins extending from said driveshaft pulley through said pin receivers whereby said pins limit any rotational slippage between the harmonic balancer and the driveshaft pulley.

3. A harmonic pulley system mounted on a vehicle engine including a crankshaft, said harmonic pulley system comprising:

a harmonic balancer having a first ledge, a second ledge, a plurality of pin receivers, an annular ring and a central aperture, a driveshaft pulley having an inner and outer region, said inner region including a first shoulder and presenting a pulley aperture said outer region including a second shoulder, a crankshaft bolt received by the crankshaft through said pulley aperture and said central aperture wherein said driveshaft pulley is compressed towards said balancer, said first ledge receiving said first shoulder, said second ledge receiving said second shoulder, said annular ring, positioned therebetween, and a plurality of alignment pins extending from said driveshaft pulley and through said harmonic balancer at said pin receivers whereby said pulley aperture of said driveshaft pulley is aligned with said central aperture of said harmonic balancer.

4. The combination apparatus or claim 1 wherein said alignment structure further comprises:

said harmonic balancer including a plurality of radially extending spokes; and a plurality of alignment pins extending from said driveshaft pulley, said pins aligned with said spokes whereby said pins limit any rotational slippage between the harmonic balancer and the driveshaft pulley.

5. The combination apparatus of claim 1 wherein said alignment structure further comprises:

said harmonic balancer including a plurality of radially extending spokes;

a plurality of pin receivers aligned with said spokes; and a plurality of pins received by said pin receivers whereby said receivers limit any rotational slippage between the harmonic balancer and the driveshaft pulley.

6. A harmonic pulley system mounted on a vehicle engine including a crankshaft, said harmonic pulley system comprising:

a harmonic balancer having a first ledge, a second ledge, a plurality of radially extending spokes, an annular ring and a central aperture, a driveshaft pulley having an inner and outer region, said inner region including a first shoulder and presenting a pulley aperture said outer region including a second shoulder, a plurality of pin receivers adapted to limit any rotational slippage between the harmonic balancer and the driveshaft pulley, a crankshaft bolt received by the crankshaft through said pulley aperture and said central aperture wherein said driveshaft pulley is compressed towards said harmonic balancer, said first ledge receiving said first shoulder, said second ledge receiving said second shoulder, said annular ring positioned therebetween, and a plurality of pins extending through said driveshaft pulley and through said harmonic balancer and received at said pin receivers wherein said driveshaft pulley is aligned with said spokes of said harmonic balancer.

* * * * *